US009381421B2

(12) United States Patent
Vaughn

(10) Patent No.: US 9,381,421 B2
(45) Date of Patent: Jul. 5, 2016

(54) GOALIE PAD

(71) Applicant: Michael A. Vaughn, Oxford, MI (US)

(72) Inventor: Michael A. Vaughn, Oxford, MI (US)

( * ) Notice: Subject to any disclaimer, the term of this patent is extended or adjusted under 35 U.S.C. 154(b) by 0 days.

(21) Appl. No.: 14/536,078

(22) Filed: Nov. 7, 2014

(65) Prior Publication Data

US 2015/0128325 A1 May 14, 2015

Related U.S. Application Data

(60) Provisional application No. 61/901,479, filed on Nov. 8, 2013.

(51) Int. Cl.
*A63B 71/12* (2006.01)

(52) U.S. Cl.
CPC ..... *A63B 71/1225* (2013.01); *A63B 2071/1258* (2013.01); *A63B 2071/1275* (2013.01); *A63B 2102/24* (2015.10); *A63B 2209/02* (2013.01)

(58) Field of Classification Search
CPC ..... A63B 71/1225; A41D 13/065; A41D 13/0568; A41D 13/08
USPC ..... 2/22, 23, 24, 911, 16
See application file for complete search history.

(56) References Cited

U.S. PATENT DOCUMENTS

| | | | | | |
|---|---|---|---|---|---|
| 2,266,886 | A * | 12/1941 | McCoy | A41D 13/015 | 2/16 |
| 3,259,910 | A * | 7/1966 | Daignault | 2/24 | |
| 4,868,926 | A * | 9/1989 | Lowson | 2/22 | |
| 5,093,931 | A * | 3/1992 | LaBerge | A63B 71/12 | 2/22 |
| 5,617,580 | A * | 4/1997 | DiCesare et al. | 2/22 | |
| 6,178,556 | B1 * | 1/2001 | Foreman | A63B 71/08 | 128/882 |
| 6,272,682 | B1 * | 8/2001 | Fullum | A63B 71/1225 | 128/882 |
| 6,393,610 | B1 * | 5/2002 | Parks | A41D 13/0568 | 128/882 |
| 7,941,867 | B2 * | 5/2011 | Olson | A61F 5/0104 | 2/22 |

* cited by examiner

*Primary Examiner* — Tejash Patel
(74) *Attorney, Agent, or Firm* — Foster, Swift, Collins & Smith, P.C.; Zachary W. Behler

(57) ABSTRACT

An inventive hockey pad with a recoil plate added to the pad to protect the internal padding by spreading impact loads, giving the pad longer performance life. In the preferred embodiment, the recoil plate is constructed of flexible carbon fiber that returns to its original shape. This property of the recoil plate effectively forces the pad back into its original shape after it is flexed.

19 Claims, 6 Drawing Sheets

GOALIE PAD

CROSS REFERENCE TO RELATED APPLICATIONS

This application claims priority to U.S. provisional application Ser. No. 61/901,479, entitled "Flex Control System for Goalie Pads," filed Nov. 8, 2013.

FIELD OF INVENTION

The present invention is in the field of pads for hockey goalies.

BACKGROUND

In ice hockey, the goaltender, also known colloquially as the goalie, is the player who defends his or her team's goal by stopping shots of the puck from entering his or her team's net, thus preventing the opposing team from scoring. Because of the power of shots, the goaltender wears special equipment designed to protect the body from direct impact. Special goaltending equipment is subject to specific regulations. For example, many other professional and non-professional leagues adhere to equipment size regulations based on International Ice Hockey Federation rules. The National Hockey League (NHL) specifies maximum dimensions of goaltending equipment to prevent goalies from having an unfair puck blocking advantage. Current NHL rules restrict leg pad width to 11 inches (280 mm); the overall height is restricted based upon an individual proportionally. The leg pads generally come to about 8 to 10 inches above the knee. Similar regulations are in place for blockers, gloves, chest pads, and other goalie equipment.

As pads are used, the interior padding begins to break down as a result of general wear and tear and impacts by pucks. Through this process the pad will deform from its initial optimal dimensions. Further, as the pad wears, the interior can soften, such that the flex and performance of the pad diminishes even though the exterior of the pad may not show excessive wear. Thus, a need exists to provide an improved pad with increased durability and flex control that will maintain performance over time.

The present invention solves this need by providing a pad in which the padding is made up of a plurality of layers, where at least one layer is a recoil plate constructed from a semi-rigid material such as flexible carbon fiber. Such a configuration stabilizes the shape of the pad by decreasing compression in height, width, and/or depth, thus holding the body of the pad in optimal shape. This configuration also holds the edges of the pad straighter and thus enables the pad to lay flatter on the ice when in use.

SUMMARY

The present invention provides a hockey pad with a stronger structure with added stability to keep the pad length and width consistent and gives a solid blocking surface on all edges for maximum performance. The recoil plate is added to the pad to protect the internal padding by spreading impact loads, giving the pad longer performance life. In the preferred embodiment, the recoil plate is constructed of flexible carbon fiber that returns to its original shape. This property of the recoil plate effectively forces the pad back into its original shape after it is flexed. The carbon fiber can be stacked in layers like a leaf spring so as to tune where the pad has more flex or less flex to match how the goaltenders want the pad to react. Other strips of carbon fiber can be added anywhere in the body of the pad to increase the return effect. By having the carbon fiber support the internal padding, the foam used can be of less density and save weight.

BRIEF DESCRIPTION OF THE DRAWINGS

The Description of the Preferred Embodiment will be better understood with reference to the following figures.

DESCRIPTION

The following description is presented to enable any person skilled in the art to make and/or use the invention. For purposes of explanation, specific nomenclature is set forth to provide a thorough understanding of the present invention. Descriptions of specific embodiments or applications are provided only as examples. Various modifications to the embodiments will be readily apparent to those skilled in the art, and general principles defined herein may be applied to other embodiments and applications without departing from the spirit and scope of the invention. Thus, the present invention is not intended to be limited to the embodiments shown, but is to be accorded the widest possible scope consistent with the principles and features disclosed herein.

Figure 1:
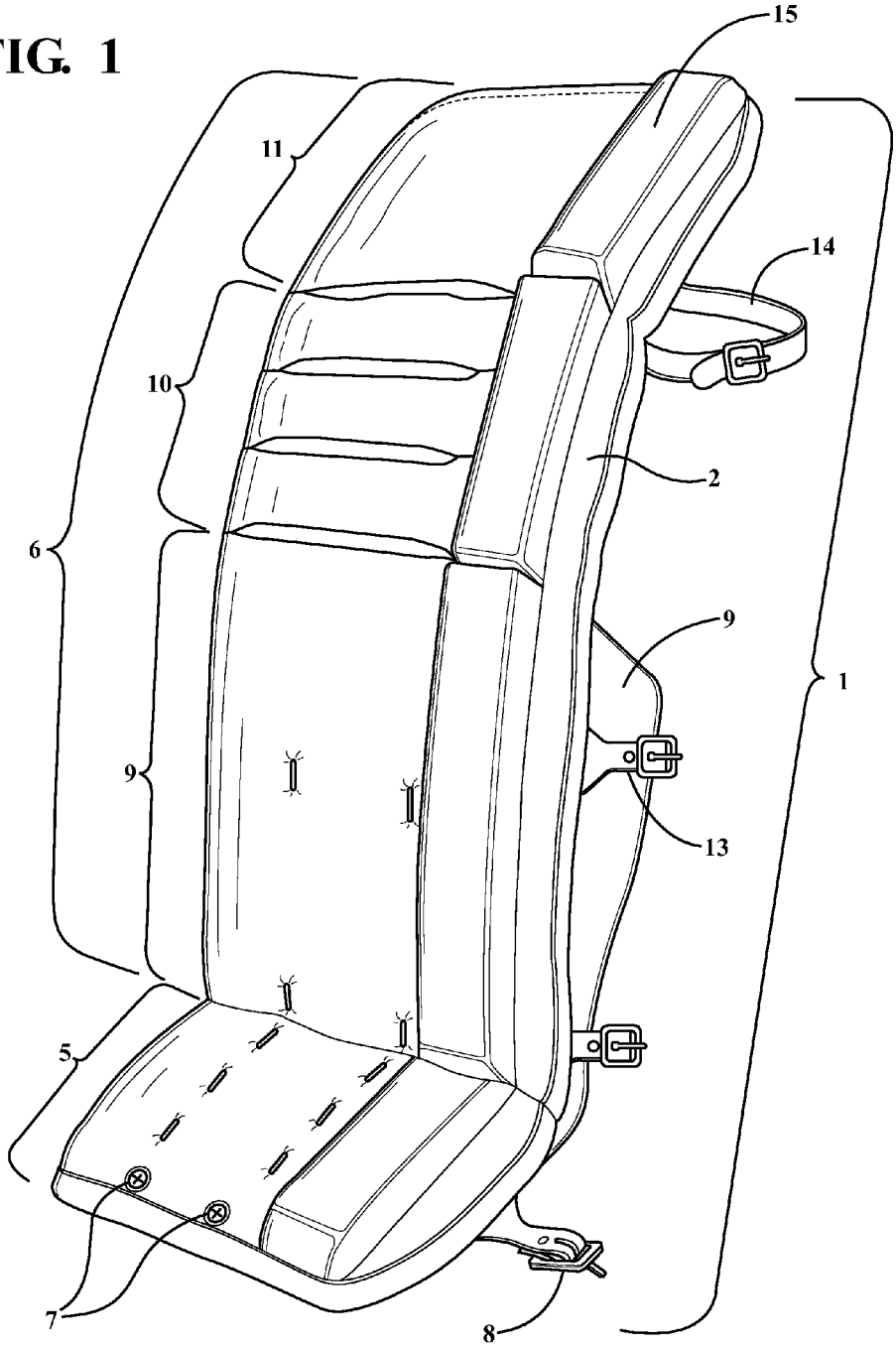
FIG. 1 is a side view an embodiment of the inventive goalie pad.

At least one of the inventive embodiments of the goalie pad is a pad 1 that comprises an outer hull 2, a recoil plate 3, and internal padding 4. FIG. 1 is a side view an embodiment of the inventive goalie pad 1. As depicted in FIG. 1, the pad 1 is configured with a lower portion 5 to protect the user's foot and an upper portion 6 to protect the user's lower leg. The outer hull 2 surrounds the pad's inner components in both the lower portion 5 and the upper portion 6 of the pad 1, and it is the portion of the pad that is intended to facilitate the connection of the pad 1 to the user. The outer hull 2 can be made of any material suitable for constructing a hockey pad. Typically, these materials include canvas, synthetic leather, neoprene, nylon, rubber, synthetic materials, etc. Examples of outer hull 2 components include toe pieces, overlays, straps, knee cradles, buckles, zippers, underlays, combinations thereof, and the like.

In the preferred embodiment the lower portion 5 is equipped with holes 7 which may be used to attach the pad 1 to a skate. The lower portion 5 may also be fitted with buckles 8 or other fastening mechanism suitable for securing the lower portion 5 to the user's ankle. The upper portion 6 may be divided into sections that cover the user's shin 9, knee 10, and leg above the knee 11. In the shin section 9 panels 12 may be attached so as to cover the sides of the user's legs while the pad in use. These panels 12 may facilitate the attachment of the pad 1 to the user by including buckles 13. In the knee section 10 a knee cradle 14 may be used to increase mobility and fit around the user's knee. In both the upper portion 6 and the lower portion 5, a rail 15 is positioned on the outstep edge to aid in puck blocking. The outer hull 2 is configured with at least one space suitable for accepting the inner padding 4 of the pad 1.

Figure 2:
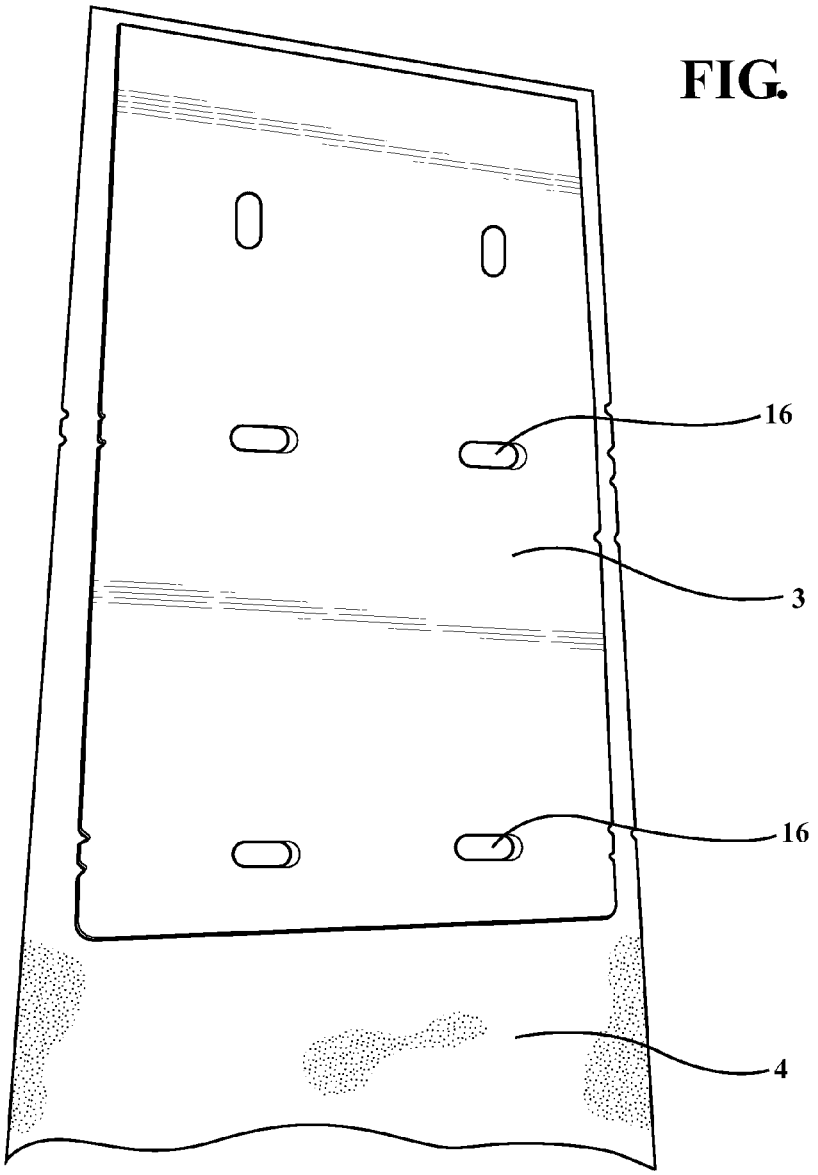
FIG. 2 is a top view of the recoil plate before it is placed inside the outer hull.

The inventive pad 1 also includes a recoil plate 3. The recoil plate 3 is a semi-rigid structure that can be directly or indirectly fastened to the outer hull 2 or internal padding 4. The recoil plate 3 can be made using a variety of materials suitable to meet strength, elasticity, and cost constraints. In the preferred embodiment, the recoil plate is constructed of carbon fiber with a cured polypropylene resin. However, other materials such as high tensile strength synthetic fibers such as KEVLAR, fiberglass or combinations could be used as well as long as the material was not prohibitively brittle. Any connection mechanism may be used to secure the recoil plate 3 including adhesive, stitching, or fasteners. The recoil plate 3 may also simply "float" within the internal padding or between the internal padding 4 and the outer hull 2. FIG. 2 is a top view of the recoil plate 3 before it is placed inside the outer hull 2. In the preferred embodiment, holes 16 are placed in the recoil plate 3 and internal padding 4 (FIG. 5) so that straps may be passed through them to secure the internal padding 4 and recoil plate 3 to the outer hull. Such anchoring holes 4 can be used to support straps or laces to help bind the outer hull 2 to the internal padding 4.

Figure 3:
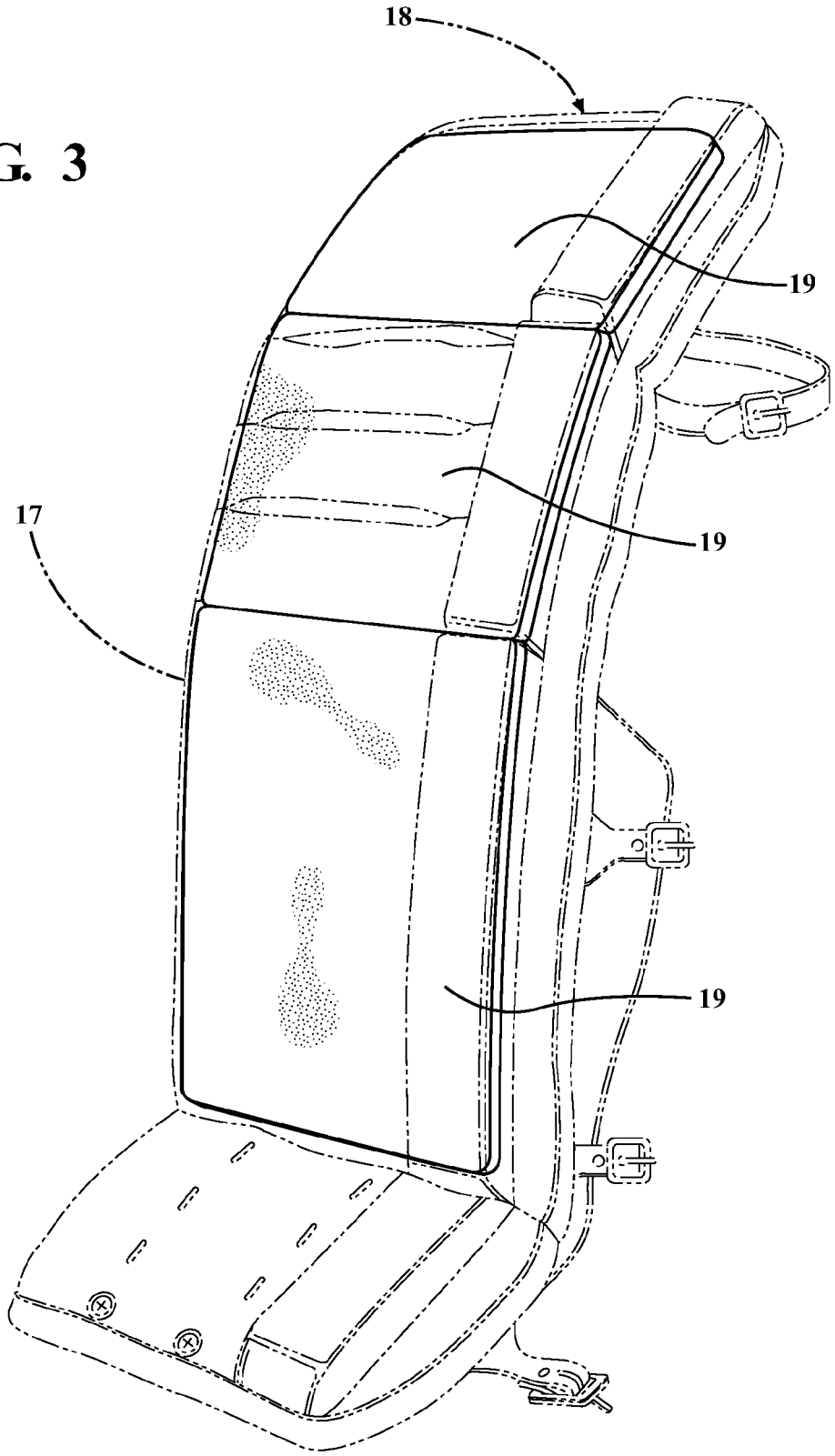
FIG. 3 is a front view of an embodiment of the pad with the outer hull cut away to reveal the layered recoil plate feature.

The recoil plate 3 protects the internal padding 4 by spreading impact loads giving the pad longer performance life. In the preferred embodiment, the recoil plate 3 is constructed of flexible carbon fiber that returns to its original shape. This property of the recoil plate 3 effectively forces the pad 1 back into its original shape after it is flexed. The carbon fiber can be stacked in layers like a leaf spring so as to tune where the pad 1 has more flex or less flex to match how the goaltenders want the pad 1 to react. FIG. 3 is a front view of an embodiment of the pad 1 with the outer hull 2 cut away to reveal this feature. Additional strips of carbon fiber can be added inside the outer hull 2 of the pad 1 to increase the return effect. By having the recoil plate 3 support the internal padding 4 the material used to construct the internal padding 4 can be of less density and save weight.

In the preferred embodiment, the recoil plate 3 is configured to fit the entire front surface 17 (FIG. 3) of the pad 1 between the user's ankle and the upper edge 18 of the pad 1. The recoil plate 3 may be constructed of a single sheet of semi-rigid material, but may also include a plurality of sheets 19. By utilizing multiple sheets, the pad can be designed to have increased rigidity in high impact areas. This can lead to more even wear and tear on the pad 1. Layering can also be used to control the amount of energy absorbed by the pad 1 when impacted by the puck. This may be useful to a goalie by creating uniform impact characteristics across the surface of the pad 1. Such uniform absorption characteristics help the goalie control the distance and speed at which the puck deflects off of the pad 1.

Figure 4:
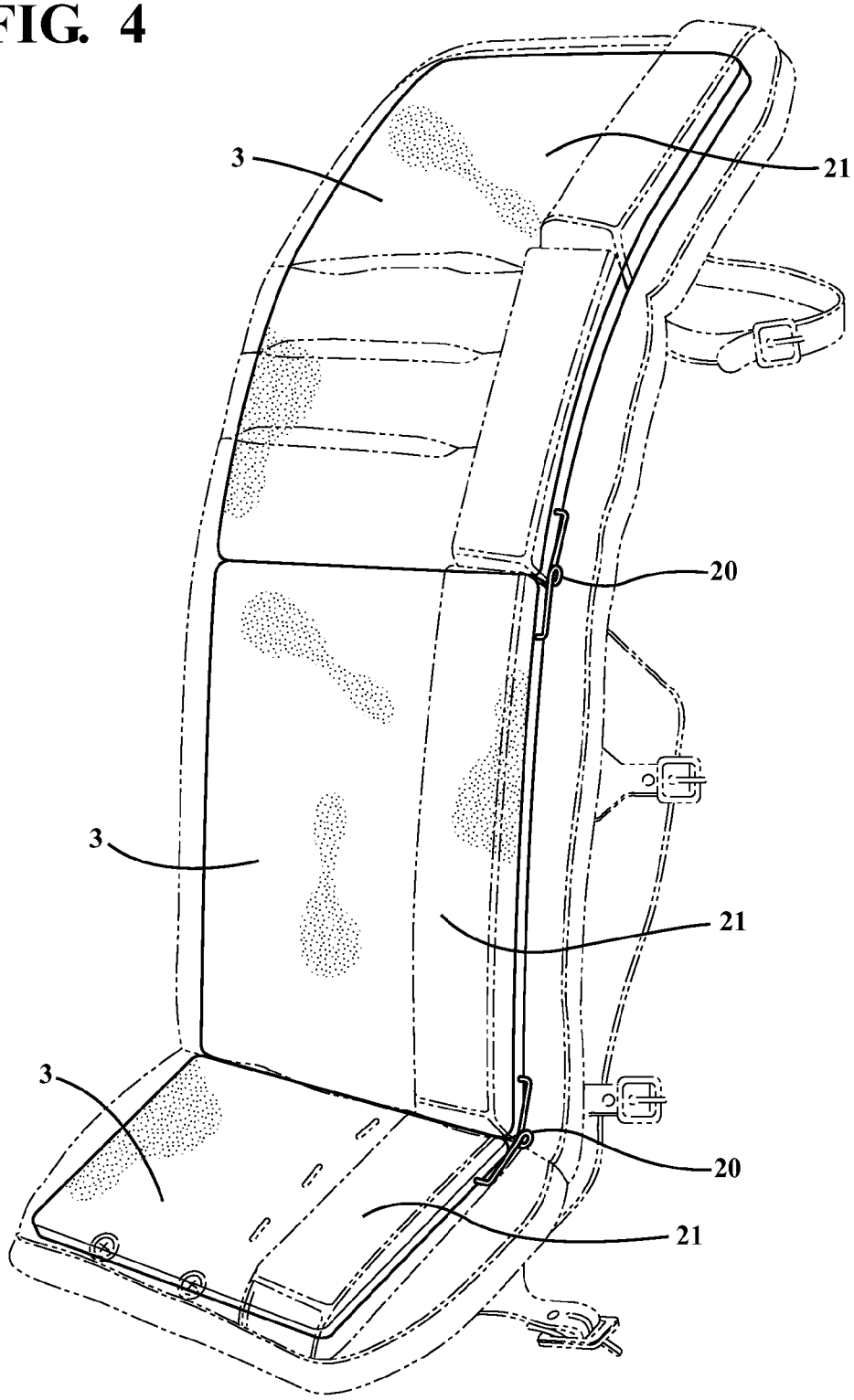
FIG. 4 is a front view of an embodiment of the pad with the outer hull cut away to reveal the sectioned recoil plate feature.

Alternatively, the same recoil effect could be created by utilizing at least one mechanical spring 20 and rigid recoil plate 3. Such an embodiment is featured in FIG. 4. As shown in FIG. 4, the mechanical springs 20 could be made of metal or other material with suitable flex and recoil properties. In such an embodiment, the recoil plate 3 may be divided into several sections 21. Springs 20 are then attached to the recoil plate 3 in a loaded fashion so as to force the recoil plate 3 to push the pad 1 back into its original position after it has been flexed.

Figure 5:
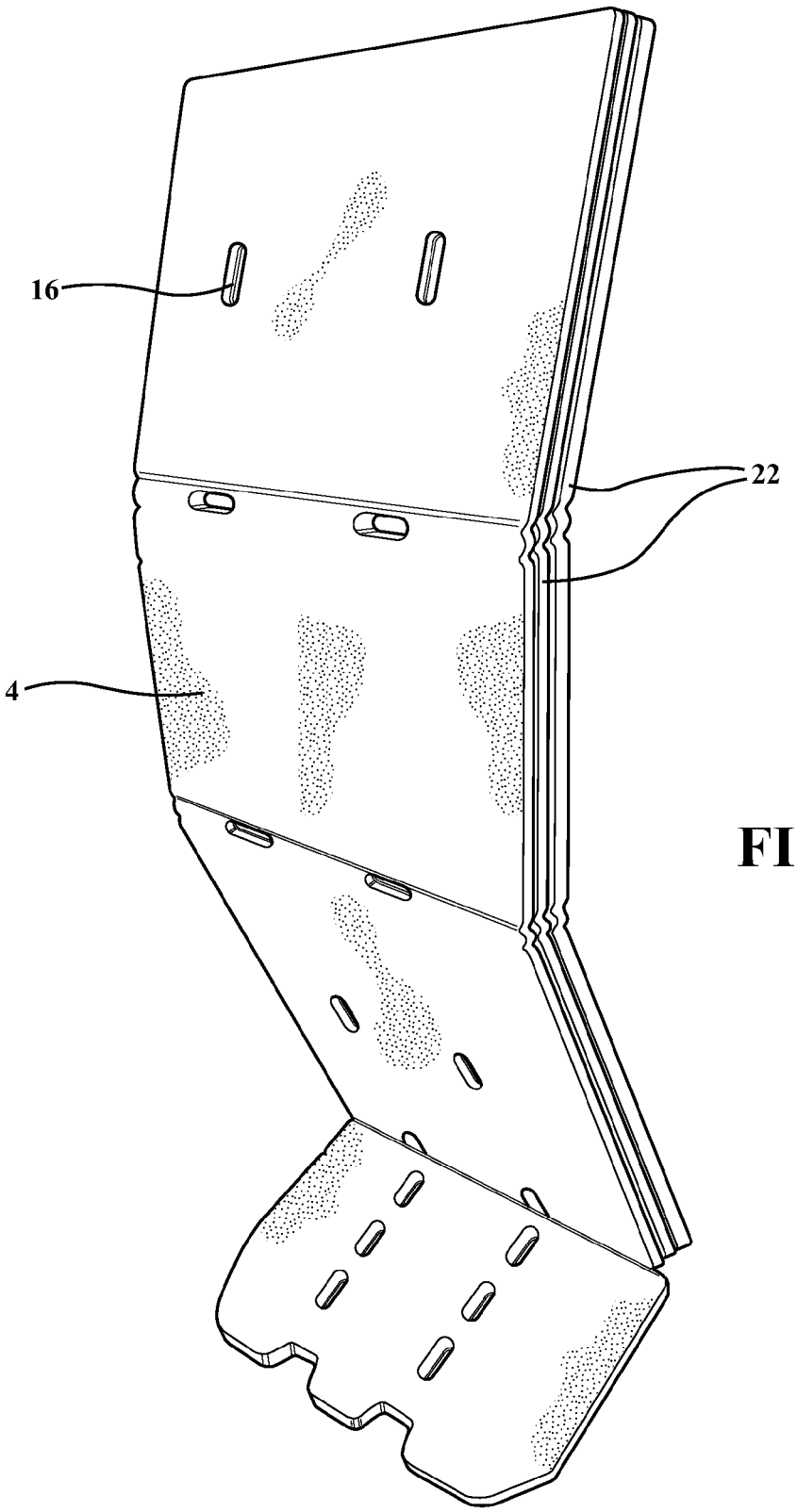
FIG. 5 is a top view of the internal padding before it is placed inside the outer hull.

The inventive pad 1 also includes internal padding 4. FIG. 5 is a top view of the recoil plate 3 before it is placed inside the outer hull 2. The internal padding 4 is a media that fills at least one cavity in the outer hull 2. The internal padding 4 can be composed of several layers 22 with varying densities. The internal padding 4 can be made using a variety of materials suitable to absorb impacts from pucks. In the preferred embodiment, the inner padding 4 is constructed with special high density foams formed in segments with multiple layers 22 and varying densities of foams to provide longevity to the shape, consistency of feel and superior rebound control. However, other materials such as feathers, open cell foams, close cell foams, polyester, or similar materials, either alone or in combination could be used as well.

The recoil plate 3 may be placed between layers of internal padding 4. Such a configuration can be used to increase or decrease the impact absorption characteristics of the pad 1. This can be done by varying the thickness and density of the padding 4 inserted between the recoil plate 3 and the front of the outer hull 2.

Figure 6:
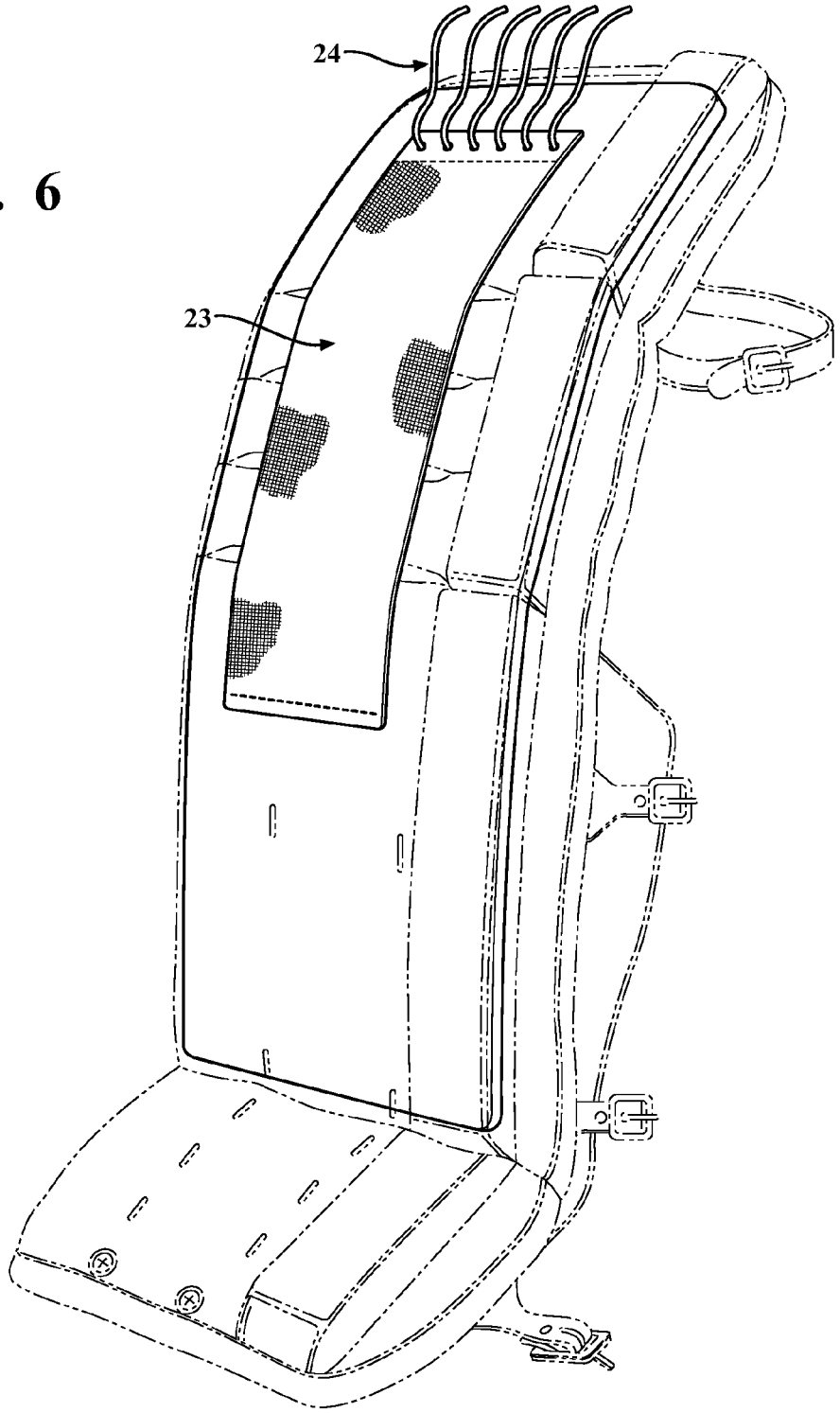
FIG. 6 is a front view of an embodiment of the pad with the elastic strap feature.

An elastic strap 23 can be added to increase the responsiveness of the recoil plate 3 and further enhance the performance of the pad 1. FIG. 6 is a front view of an embodiment of the pad with the elastic strap 23 feature. This strap 23 can be anchored to the recoil plate 3 using laces 24 or other comparable fastening systems such as loop and hook or buckles. The laces 24 can then be can be tightened so the elastic strap 23 exerts an adjustable amount of tension on the recoil plate 3. Adding more tension to the strap 23 assists the recoil plate 3 in returning to its original shape.

The invention claimed is:

1. A hockey goalie leg pad assembly adapted to protect the leg from impacts comprising:

an outer hull comprising a means for attaching a pad to the user's leg and inner cavity configured to accept the internal padding and recoil plate;

a recoil plate located inside the inner cavity of the outer hull that moves substantially independently within the inner cavity of the outer hull; and internal padding located inside the inner cavity of the outer hull that moves substantially independently within the inner cavity of outer hull.

2. The pad of claim 1, wherein the means for attaching the outer hull to the user comprises a knee cradle.

3. The pad of claim 1, wherein the outer hull further comprises panels configured to cover the sides of the user's legs while the pad is in use.

4. The pad of claim 1, wherein the recoil plate is constructed of self-reinforced plastic.

5. The pad of claim 4, wherein the recoil plate is at least in part constructed of carbon fiber.

6. The pad of claim 1, further comprising:

holes in the recoil plate configured to accept straps; and straps configured to pass through holes in the recoil plate to secure the recoil plate to the outer hull.

7. The pad of claim 1, wherein the recoil plate is divided into sections.

8. The pad of claim 7, wherein the recoil plate comprises a plurality of sheets stacked to manipulate the flex pattern of the pad.

9. The pad of claim 1, wherein the recoil plate is configured to fit substantially the entire front surface of the pad.

10. The pad of claim 1, further comprising:

at least one mechanical spring;

at least one rigid recoil plate; and a means for attaching a mechanical spring to a rigid recoil plate in a loaded fashion.

11. The pad of claim 1, further comprising:

at least one elastic strap comprising a first end permanently affixed to the outer hull; and a second end attached to a means for stretching the elastic strap to put forward pressure on the recoil plate.

12. The pad of claim 1, wherein the internal padding is constructed of at least two independent layers of high density foam that are able to move independently from each other within the internal cavity of the outer hull.

13. The pad of claim 12, wherein the recoil plate is located between layers of internal padding.

14. The pad of claim 12, wherein the density of layers is increased in high impact areas.

15. The pad of claim 12, wherein the thickness of layers is increased in high impact areas.

16. The pad of claim 1, wherein the outer hull is configured with at least one space suitable for accepting the inner padding.

17. The pad of claim 1, wherein the recoil plate is spring loaded to force the pad back into its original shape after it is flexed.

18. The pad of claim 5, wherein the recoil plate is constructed of carbon fiber stacked in layers.

19. The pad of claim 18, wherein the recoil plate has an increased number of layers of carbon fiber in high impact areas.

* * * * *